United States Patent [19]

Cole

[11] Patent Number: 4,964,429

[45] Date of Patent: Oct. 23, 1990

[54] COSMETICS APPLICATOR

[76] Inventor: Rodney D. Cole, Welbeck House, High Street, Guildford, Surrey, United Kingdom

[21] Appl. No.: 173,123

[22] Filed: Mar. 25, 1988

[30] Foreign Application Priority Data

Mar. 25, 1987 [GB] United Kingdom ..... 8707086

[51] Int. Cl.[5] ..... A45D 40/26

[52] U.S. Cl. ..... 132/218; 132/216; 401/126; 401/129

[58] Field of Search ..... 132/216, 218, 320; 401/126, 129; 15/159 A, 186, 187, 167.1, 206

[56] References Cited

U.S. PATENT DOCUMENTS

| | | | |
|---|---|---|---|
| 2,151,416 | 3/1939 | Black et al. | 15/186 |
| 3,921,650 | 11/1975 | Montgomery | 132/218 |
| 3,968,536 | 7/1976 | Leighton et al. | 15/187 |
| 4,565,205 | 1/1986 | Taylor | 132/218 |
| 4,617,948 | 10/1986 | Guéret | 132/218 |
| 4,619,012 | 10/1986 | Wachtel | 15/159 A |
| 4,662,385 | 5/1987 | Schefer | 132/218 |

FOREIGN PATENT DOCUMENTS

| | | | |
|---|---|---|---|
| 2170996 | 3/1985 | United Kingdom | 132/218 |

*Primary Examiner*—John J. Wilson
*Assistant Examiner*—Frank A. LaViola, Jr.
*Attorney, Agent, or Firm*—Lerner, David, Littenberg, Krumholz & Mentlik

[57] ABSTRACT

A cosmetics applicator has a handle and a stem projecting from the handle. A multiplicity of elements project laterally from the stem. Some of the elements are relatively flexible bristles, for retaining mascara in the interstices between the bristles, and others of the elements are relatively stiff teeth for providing a combing effect upon application.

16 Claims, 4 Drawing Sheets

FIG. 1
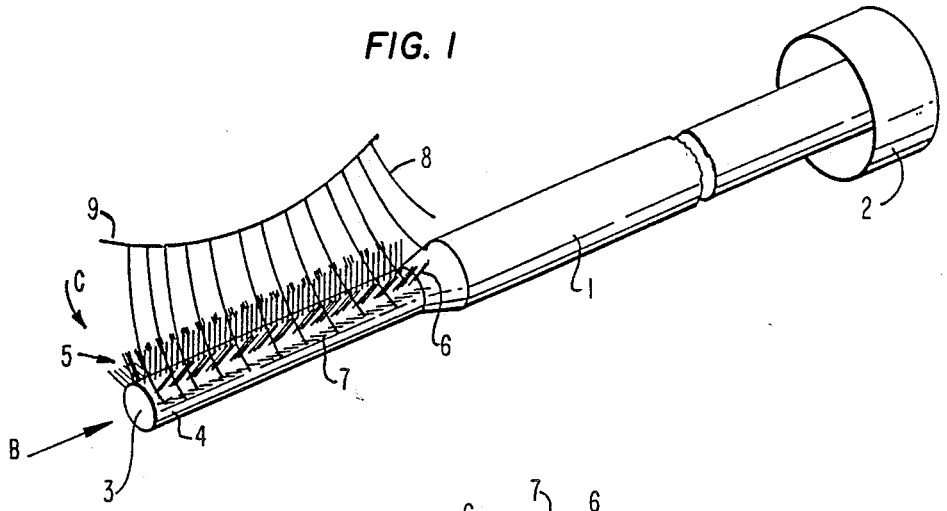
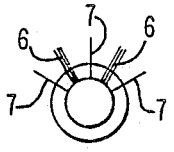
FIG. 2
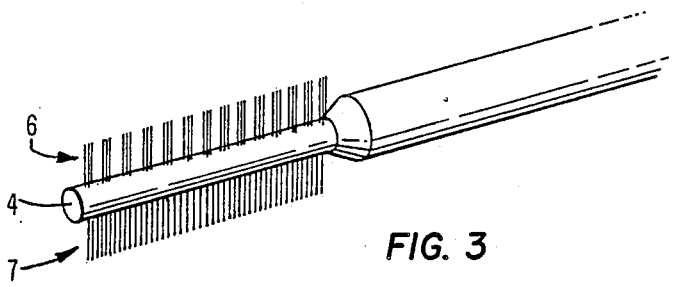
FIG. 3

FIG. 7
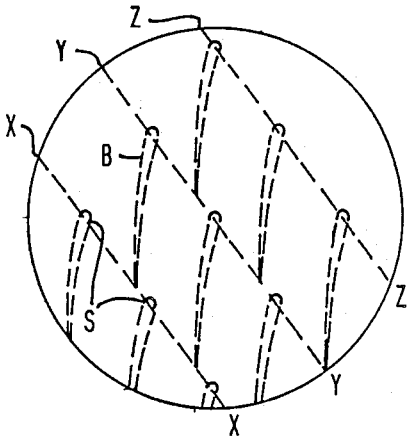
FIG. 8
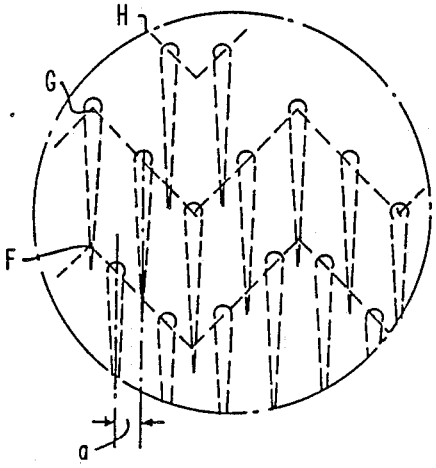
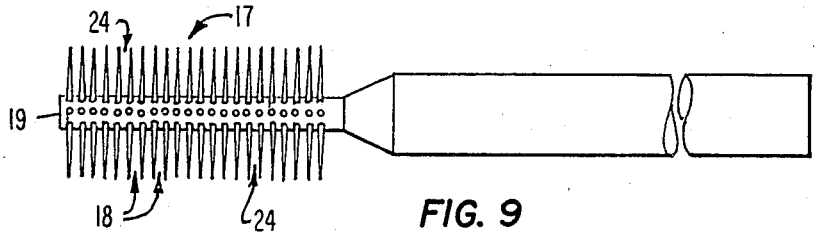
FIG. 9
(PRIOR ART)
FIG. 10
(PRIOR ART)
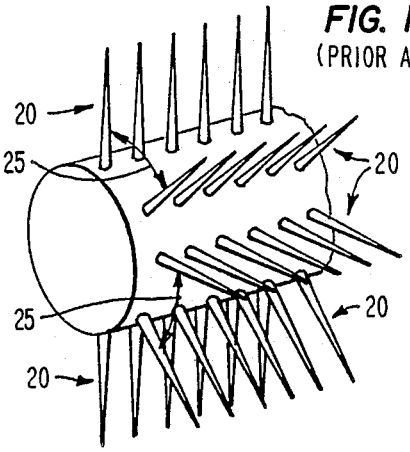
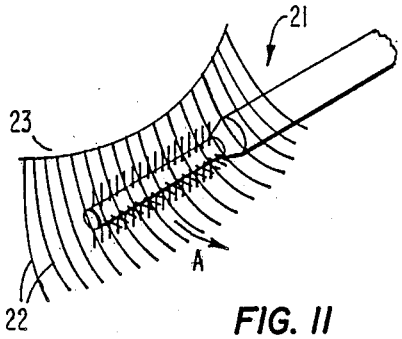
FIG. 11
(PRIOR ART)

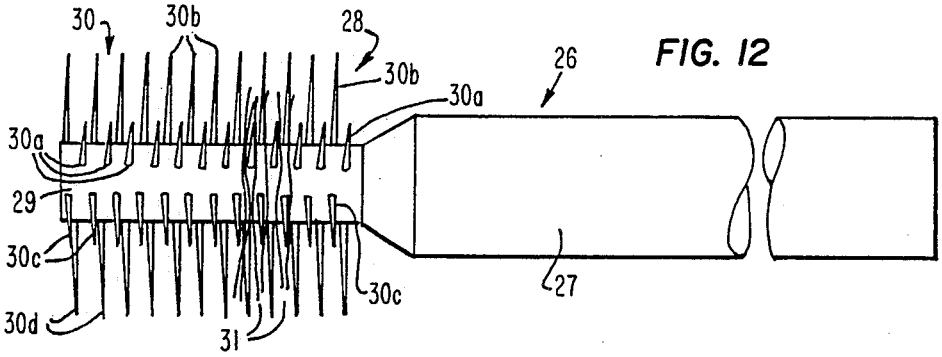
FIG. 12
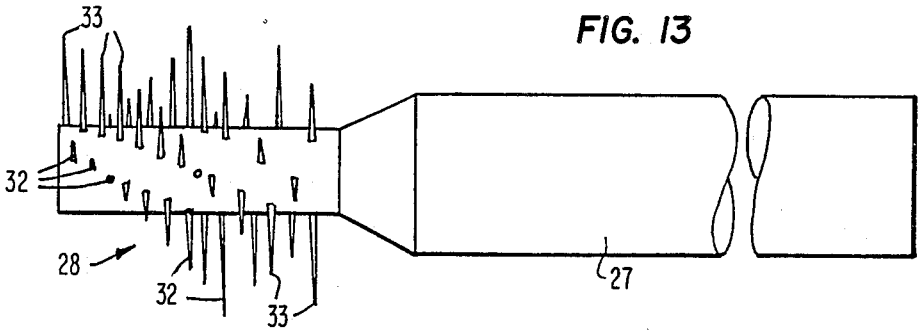
FIG. 13
FIG. 14
(PRIOR ART)
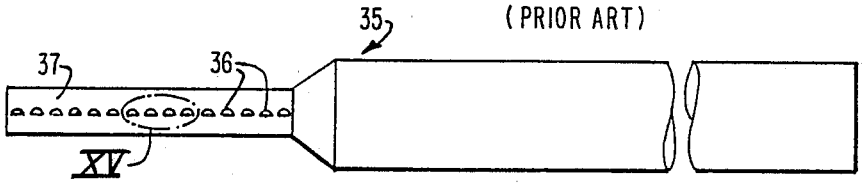
FIG. 15
(PRIOR ART)
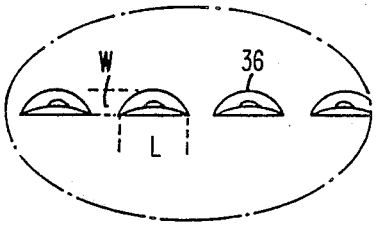
FIG. 16
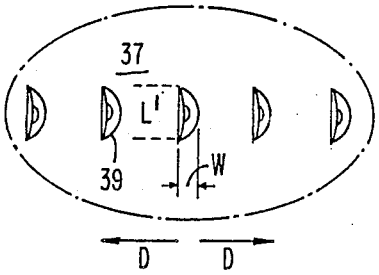

COSMETICS APPLICATOR

This invention relates to an applicator for applying a liquid, semi-liquid, creamy, paste-like or viscous material. It is particularly, but not exclusively, concerned with an applicator for applying a colouring cosmetics product (mascara) to the eyelashes.

Various forms of mascara applicator are known. In a first such known form, a minature twisted wire stem brush projects axially from the end of a carrier shaft, a multiplicity of bristles being rooted in the wire stem and projecting radially therefrom in the form of helical flightings. In a second known form, a multiplicity of laterally projecting flexible teeth or bristles are integrally molded from a plastics material with a stem, the teeth or bristles forming a plurality of circumferentially distributed, axially extending rows.

The present invention seeks in its various aspects to provide improvements over either one or both of these known forms of applicator.

According to a first aspect of the invention, there is provided an applicator for a liquid, semi-liquid, creamy, paste-like or viscous cosmetics material, comprising a handle portion, and a head portion having a stem and a multiplicity of elements projecting laterally from said stem, said multiplicity of elements including relatively stiff teeth and relatively flexible bristles.

Such a construction satisfies the two requirements for achieving a pleasing make-up effect on the eyelashes, these being firstly the retention and application of mascara to the eyelashes, and secondly the combing and separation of the eyelashes to which the mascara has been applied. The mascara is retained in the interstices between the relatively flexible bristles whence they can be applied to the eyelashes, and the combing effect is provided by the relatively stiff teeth.

Preferably, the teeth and bristles are formed in respective separate rows. In a particular arrangement to be described later herein in accordance with this first aspect there are respective pluralities of rows of the bristles and teeth, these bristle and teeth rows being distributed circumferentially and alternately around at least a part of the stem. This arrangement has the particular advantage that mascara application and eyelash combing are both effected on each stroke of the applicator head against the eyelashes.

In a simplified construction, the head has a single row of bristles and a single of row of teeth. If these two rows are arranged to be circumferentially adjacent one another, the abovementioned effect of simultaneous application and combing can be achieved. However, it should be noted that this arrangement of the row or rows of bristles circumferentially adjacent the row or rows of teeth is not essential. For example, the single row of teeth could be provided at a circumferential position diametrically opposed to that of the single row of bristles; with such an arrangement, the mascara would be applied to the eyelashes using the row of bristles, and the applicator would then be rotated through 180° to use the row of teeth to effect the combing and separation of the eyelashes.

The background to a second aspect of the invention will now be given. It is known to construct an applicator in such way that it can be assembled to a container for the material to form a cosmetics package. In order to clean the outer surface of the shaft of the applicator, and to limit the amount of material remaining on the applicator after it has been withdrawn from the container, it is known to provide in the container neck a wiper defining an orifice through which the shaft and applicator head pass on withdrawal from the container. As the applicator head is withdrawn through the wiper orifice, each bristle is made to deflect forwardly toward the applicator tip as the part of the stem in which the bristle is rooted, or from which it extends, passes through the wiper orifice. In the above-described known applicators, each bristle presses against a longitudinally adjacent bristle as it becomes forwardly deflected, and this effect produces a bunching of the bristles at the wiper orifice which causes an undesirable compression of the mascara material between the bristles. This effect is clearly illustrated in FIGS. 4A to C which show three successive stages in the withdrawal of an applicator 10 with longitudinal rows of bristles 11 through a wiper 12. The folding of the bristles onto one another can be clearly seen at region R in FIGS. 4B and 4C.

The second aspect of the present invention is directed to this problem and provides a material aplicator comprising an elongate stem and a multiplicity of flexible bristles or like filaments distributed along, and projecting laterally from said stem, at least some of said bristles being arranged other than in axially extending rows and such that they can each flex longitudinally of the stem without contacting another said filament.

In accordance with this second aspect of the invention there is also provided an applicator assembly comprising an applicator for a liquid, semi-liquid, creamy, paste-like or viscous material and a container for said material, wherein said applicator includes a heat element for retaining and applying the material, and said container includes a wiper element defining a wiping orifice through which said head element can be withdrawn from the container so as to limit the amount of material retained thereon, said head element comprising a stem and a multiplicity of bristles or like filaments distributed along said stem and projecting laterally therefrom, the arrangement of said bristles on said stem being such that as the head element is withdrawn through said wiping orifice at least some of said filaments can flex longitudinally of the stem without contacting another said filament.

This second aspect of the invention is particularly applicable where the filaments are integrally moulded from plastics material with the stem.

The filaments may, for example, form one or more rows extending helically around and along the stem. The axial spacing between adjacent turns of the helical row or rows can be less than the degree of forward deflection of the bristles as they pass through the wiping orifice if the bristles in the adjacent turns are mutually offset in a circumferential sense so that each bristle from one turn deflects into a space between two bristles of the next turn.

Numerous other arrangements are possible within the scope of this second aspect of the invention, and it will be appreciated that in many cases, the particular arrangement can be described in different terms, the multiplicity of the bristles providing an arrangement which can be considered as constituting different forms of regular pattern, depending upon how the arrangement is viewed. The important point is a general one, namely that at least the majority of the bristles, when deflected forwardly on passing through the wiping orifice will not contact another bristle. In an arrangement where a high density of bristles in required over the circumferential area of the head, this avoidance of contact can be achieved by arranging for each bristle to deflect into a gap between the bristles disposed immediately forwardly of the bristle concerned.

The background to the third aspect of the invention will now be given.

FIGS. 9 and 10 illustrate a known bristle arrangement in an integrally moulded applicator. As can be seen from FIG. 9, the bristles 17 in their rows 20 form a multiplicity of rings of circumferentially aligned bristles, the rings 18 being regularly spaced axially along the applicator head 19.

FIG. 11 illustrates the manner in which a mascara brush is used for the application of mascara to the eyelashes. As shown, the brush 21, with mascara retained in the interstices between the bristles, is stroked along the eyelashes 22 in a direction A away from the eyelid 23. It will be appreciated that with this direction of stroking, the eyelashes extend generally perpendicularly to the axis of the applicator head, and therefore enter the spaces 24 between the succesive rings 18 of bristles of the FIG. 9 applicator head. As the eyelashes slide through these inter-ring spaces 24, mascara which is retained between adjacent bristles of the respective rows is applied. However, mascara is also retained in the spaces between adjacent bristles in the respective rings (e.g. space 25 in FIG. 10) and the material in these latter spaces generally remains unused since the eyelashes generally do not enter such spaces.

According to the third aspect of the present invention, there is provided an applicator for applying a liquid, semi-liquid, creamy, pasty or viscous cosmetic material, comprising a handle by which the applicator can be manipulated, and a portion for retaining and applying the material, said retaining and applying portion comprising an elongate support and a multiplicity of closely spaced bristles or filaments projecting laterally from said support, said bristles comprising at least first and second circumferentially adjacent rows extending along said support, the positions of the filaments of one row being longitudinally offset, or staggered, relative to the positions of the filaments in the other row.

The rows may extend parallel to the axis of the support.

Several such rows, e.g. ten or more, may be circumferentially distributed around the whole or part of the circumference of the support. The relative staggering need not be applied to all of the rows of filaments. Accordingly a first group of adjacent rows may be arranged such that each is staggered relative to at least one of its neighbours, while a second group may be arranged without any such staggering.

In a particular arrangement according to this third aspect, the filaments are regularly spaced along said rows, and the filaments in adjacent rows are offset by half the filament spacing so that every other row is in circumferential alignment.

With the arrangement of filaments according to this third aspect of the invention, the eyelashes are made to fall into a more convoluted path between the filaments of adjacent rows, thus ensuring a more efficient application to the eyelashes of the material retained in the interstices between the filaments.

The filaments are preferably integrally molded with the support from a suitable plastics material.

The background to a fourth aspect of the invention will now be given.

FIG. 14, is a side elevation of integrally moulded mascara applicator 35 which, for the purposes of illustration, is formed with a single axial row of flexible teeth 36 of known form, the teeth being seen end-on in the figure. FIG. 15 is an enlarged view showing a few of these teeth. The manner in which the teeth are integrally moulded with the stem 37 produces a cross-sectional shape which is generally elongate in an axial direction; that is to say, the maximum dimension L measured axially of the stem exceeds the maximum dimension W measured circumferentially of the stem. Accordingly, as the applicator is withdrawn from and reinserted into a cosmetics container through a wiper orifice, the teeth 36 are mde flex in a direction parallel to that of their greater cross-sectional dimension L (hereinafter called sectional length). Flexing in such direction tends to be unstable and places great strain on the plastics material in the region of the bases of the teeth adjacent their joints with the stem. In extreme cases, fatigue at these points may become so serve as to cause loss of flexibility and even breakkage from the stem.

The fourth aspect of the invention is directed to this problem, and provides an applicator for applying a liquid, semi-liquid, creamy, pasty or viscous material, comprising a handle by which the applicator can be manipulated, and a portion for retaining and applying the material, said retaining and applying portion comprising an elongate support and a multiplicity of flexible filaments projecting laterally from, and integrally formed with said support, at least some of said filaments having a cross-sectional shape at their base portions adjacent the support, which is generally elongate in that it has a maximum dimension in one direction greater than its maximum dimension in an orthogonal direction, wherein said at least some filaments are positioned such that said one direction extends substantially transaxially of the support.

With this arrangement the filaments flex in a direction transverse rather than parallel to their sectional length as the retaining and applying portion passes through a wiper orifice. This provides easier flexing and impose a much smaller strain on the material of the base portions of the teeth as they flex longitudinally of the support.

Reference will now be made to the accompanying drawings in which:

FIG. 1 is a perspective view illustrating a cosmetics applicator in accordance with the first aspect of the present invention;

FIG. 2 is an end profile view of the applicator of FIG. 1, as seen in the direction B;

FIG. 3 is a perspective view illustrating another cosmetics applicator in accordance with the first aspect of the present invention;

FIG. 7 is an enlarged view, similar to that of FIG. 6, but showing part of a modified applicator head in which the bristles are distributed circumferentially so as to provide a greater bristle density than in the arrangement of FIGS. 5 and 6;

FIG. 8 is an enlarged view, similar to that of FIG. 7 showing a part of another modified applicator head providing high bristle density;

FIG. 9 is a side elevational view illustrating part of a known form of integrally molded mascara applicator;

FIG. 10 is an enlarged perspective view of an end portion of the head of the applicator shown in FIG. 9;

FIG. 11 is a schematic view illustrating the manner of application of mascara to the eyelashes using a brush-type applicator;

FIG. 12 is a side elevational view illustrating part of an applicator in accordance with the third aspect of the present invention; and FIG. 13 is a side elevational view of part of another form of mascara applicator according to the third aspect of the present invention;

FIG. 14 is a side elevational view of a head portion of an applicator with an arrangement of bristles of known sectional configuration;

FIG. 15 is an enlarged view of a part of the applicator of FIG. 14 showing some of the bristles in greater detail; and FIG. 16 is an enlarged view, similar to that of FIG. 15, of a part of an applicator with a bristle configuration in accordance with the fourth aspect of the present invention.

Figure 4A:
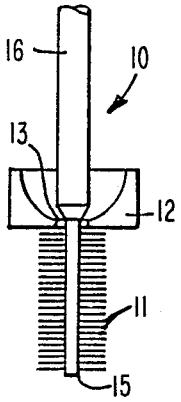
FIG. 4A (PRIOR ART)
FIGS. 4A to 4C are sectional views illustrating the manner in which bristle bunching, and mascara compression occurs when a conventional applicator with axial bristle rows passes through a wiper.

The applicator of the first embodiment illustrated in FIG. 1 and 2 comprises an elongate shaft 1 forming, or attached at one end to a handle 2 for the applicator, and having at its other end a head portion 3. This head portion comprises a stem 4 attached to, or integrally formed with the shaft 1 and extending axially therefrom, and a multiplicity of elements 5 projecting laterally from the stem 4.

These elements 5 include relatively stiff teeth 6 and relatively flexible bristles 7. In this embodiment, the elements 5 are formed as a plurality of circumferentially distributed, axially extending rows, the teeth and bristles being separated into respective such rows, the rows of teeth and the rows of bristles being circumferentially alternated, as is most clearly seen in FIG. 2.

The applicator may form part of a cosmetics package, which also includes a container (not shown) for containing the mascara or other cosmetics composition to be applied by the applicator, the handle portion 2 of the applicator constituting a closure for the container so that when the closure is fixed in its position on the container neck, the shaft 1 projects into the container and the head 3 is at least partly immersed in the cosmetics material.

In use, the applicator will be withdrawn from the container and excess product may be wiped from the head 3 upon its passage through a wiper unit mounted in the container neck. A quantity of the product will be retained, particularly in the interstices between the bristles in the bristle rows, and the product is applied to the eyelashes 8 by stroking the head against the eyelashes in the direction of arrow C away from the eyelid 9. During this stroking action, the eyelashes will enter the interstices between the bristles, and material will therefore be applied to the eyelashes. The stroking action also causes the rows of teeth 6 to effect a combing action to separating the eyelashes 8. It will be appreciated that the mascara will normally tend to stick the eyelashes together, and that this combing avoids the unsightly effect which the resulting bunching of the eyelashes would produce.

Accordingly, in the embodiment of FIGS. 1 and 2, the material application, and the combing of the eyelashes are effected simultaneously. However, this is not essential, and FIG. 3 illustrates a simplified embodiment in which the material application and the combing constitute separate operations. In this embodiment, there is a single row of teeth 6 and a single row of bristles 7, these rows being diametrically opposed with respect to the stem 4.

In use, the mascara material will first be applied using the bristles 7 and this application will be followed by combing of the eyelashes using the comb constituted by the row of bristles 6.

The present invention, in its first aspect, is not to be taken as limited to the above-described embodiments, but to include the many other arrangements and modifications which may be apparent to be person skilled in the art. For example, the rows of teeth and bristles may be regularly distributed about the whole of the circumference of the stem 4. In another modification, the teeth and bristles may be mixed within each row. Also, it is not necessary for the elements comprising the bristles and teeth to be provided in rows. Other regular arrangements of the bristles and teeth could be used, or they could alternatively be distributed entirely randomly.

Figure 4B:
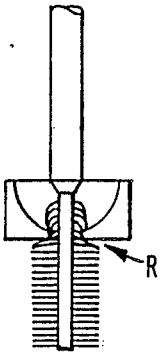
FIG. 4B (PRIOR ART)
Figure 4C:
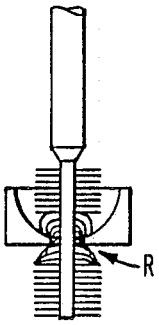
FIG. 4C (PRIOR ART)

With reference of FIG. 4, there is shown a head portion 10 of a known mascara applicator 11 during its withdrawal from a container (not shown) containing a quantity of mascara material through a wiping orifice 13 defined by an annular wiping member 12 fixed in the container neck. The sectional view of FIG. 4 shows two diametrically opposed, axially extending rows of flexible bristles 11 integrally formed, and projecting radially from a central stem 15 which extends axially from one end of a support shaft 16. The other end of this support shaft 16 may be fixed to a cap adapted to close the container neck.

As shown in FIG. 4, each bristle 11 as it is engaged by the edge of the wiper orifice 12, becomes deflected forwardly toward the lower end of the head, and in doing so bears against the next lower adjacent bristle in the same row. As explained previously, this causes a bunching of the bristles immediately beneath and within the wiper 12, and this in turn compresses mascara material between the bristles leading to an accumulation of a residue in the interstices between the bristles.

Figure 5:
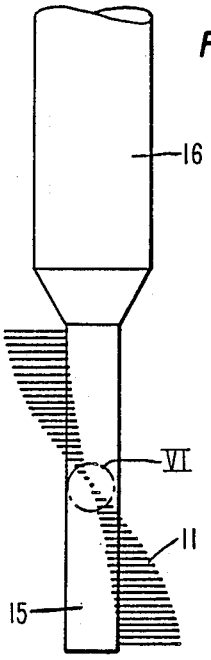
FIG. 5 is an elevational view of the head portion of an applicator in accordance with the second aspect of the invention, the applicator having a simple single helical row structure.
Figure 6:
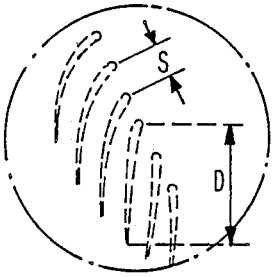
FIG. 6 is an enlarged view of the indicated portion of the head of FIG. 5, showing the manner in whic the bristles deflect fowardly when they pass through a wiping orifice.

FIGS. 5 and 6 illustrate the basis of a bristle arrangement in accordance with the second aspect of the invention which overcomes this problem. In the applicator based upon the concept of FIGS. 5 and 6, the row or rows of brisles 11, instead of being axial, are inclined to the longitudinal axis of the stem 15 so as to extend helically around the stem axis, as shown. The principle of operation of this embodiment is illustrated and described with reference to there being a single helical row of bristles, but it will be understood that a double, or multiple helical row configuration may be employed.

FIG. 6 illustrates how, when the bristles flex axially of the stem as they engage the wiper orifice, they do not come into contact with their respective neighbouring bristles in the row even though the axial deflection D is considerably greater than the spacing S between the bristles along the row.

With reference to FIG. 7, a plurality of helically extending rows may be distributed circumferentially about the stem axis, the arrangement being such that each bristle (e.g. bristle B) in a given row will deflect axially into a space S between two adjacent bristles in the adjacent row, dotted lines X13 X, Y—Y and Z—Z indicating the imaginary paths of two adjacent helical rows.

Numerous other patterns of distribution of the bristles along and around the stem are envisaged and can provide the same beneficial effect as the helical-row arrangements of FIGS. 5 to 7. For example, an arrangement as shown in FIG. 8 could be described as including a plurality of zig-zag rings, e.g. F, G, H, of bristles, the bristles in adjacent pairs of rings being circumferentially staggered (as shown by $\alpha$ as between rings F and G) so that, as with the other embodiments, each bristle will flex forwardly into a space between two adjacent bristles of the next ring.

It will be appreciated that many of the arrangements providing the advantages referred to herein in accordance with the second aspect of the invention could be described in terms or different patterns of distribution of the bristles on the stem. However, the arrangements all conform with an essential functional requirement that is to say that most, and preferably all of the bristles, when deflected forwardly on passage through the wiper orifices do not contact any other bristles.

The features of any of the applicators described with reference to FIGS. 5 to 8 in accordance with the second aspect may be advantageously combined with those of an embodiment described earlier with reference to the first aspect to produce an applicator providing the benefits of both of these aspects of the invention. For example, flexible bristles may be distributed around a major part of the cicumference of the stem in accordance with the second aspect, while one or a few adjacent rows of stiff teeth are formed at the remaining minor part. A radial slot or slots in the wiper allow the passage of such row or rows of teeth.

The embodiments of the third aspect of the invention will not be described.

The arrangement of the multiplicity of bristles on the known applicator of FIGS. 9 and 10, and its manner of use for applying mascara to the eyelashes as shown in FIG. 11 have been described previously.

With reference now to FIG. 12, an applicator 26 in accordance with the third aspect of the present invention comprise an elongate shaft 27 attached to, or constituting a handle for the applicator, and a material retaining and applying head portion 28 projecting axially from one end of said shaft 27. The head portion comprises an elongate stem 29 integrally formed with the shaft 27, and a multiplicity of radially projecting bristles 30 integrally formed with the stem 29. Accordingly, in this embodiment, the applicator is integrally molded as a one-piece element from a suitable plastics material.

The bristles 30 are arranged in a plurality of circumferentially distributed, axially extending rows, the bristles being regularly spaced in the rows. In the elevational view of FIG. 12, four bristle rows are shown for simplicity of illustration. It will be appreciated, however, that a greater circumferential density of rows may and preferably will be used.

As shown in FIG. 12, the positions of the bristles in each row are longitudinally offset, or staggered, relative to the positions of the bristles in at least one neighbouring row. For example, the bristles **30*a* are offset, in a sense longitudinally of the stem 29, with respect to the bristles 30*b* in the adjacent upper row and with respect to the bristles 30*c* in the adjacent lower row. In this particular embodiment, the offset between the bristles of one row and the bristles of the adjacent row is exactly half the bristle spacing so that the bristles in every other row are circumferentially aligned. Thus, as can be seen from FIG. 12, the bristles 30*b* are circumferentially aligned with the bristles 30*c*, and the bristles 30*a* are circumferentially aligned with the bristles 30*d*** in the lowermost illustrated row.

Reference numeral 31 in FIG. 12 indicates a few eyelashes in the positions they would adopt relative to the bristles during mascara application. Because of the axial offset, or staggering, of the bristles of respective adjacent rows, the interstices between the bristles of one row are likewise offset relative to the interstices between the bristles of an adjacent row. Accordingly, as the applicator head 28 is stroked against and along the eyelashes away from the eyelid, the eyelashes are forced to follow convoluted paths which meander between the non-aligned interstices of the adjacen rows. Furthermore, the eyelashes will flex longitudinally as they pass through these interstices. This produces a more efficient application of the material from the interstices onto the eyelashes than was achieved in the known arrangement of FIG. 9 with circumferentially registered bristles and interstices.

In the arrangement of FIG. 13, the applicator head 28 is formed with a plurality of oblique helically extending rows of bristles, the bristles in each row being non-regularly spaced along the row. The bristles in each row are, nevertheless, positioned so that they are axially offset, or staggered, relative to the bristles of the adjacent row or rows. For example, it can be seen that the bristles 32 are aligned circumferentially with the interstices between the bristles 33. Accordingly, this arrangement provides a similar improved efficency of mascara application as in the FIG. 12 embodiment.

The features described with reference to the embodiments of the third aspect may be combined in a single applicator with the features of either one or both of the previous aspects of the invention. For example, axial rows, mutually offset as illustrated in FIG. 12 could be provide over a first part (which may be a major part) of the circumference of the stem, one or more rows of stiff teeth being formed at another (minor) part. Such an applicator would incorporate both first and third aspects of the invention. In another example, also provided with a row of rows of teeth in accordance with the first aspect, the arrangement of flexible bristles over a major circumferential portion could incorporate the features of forward flexing without obstruction and longitudinal mutual offset of, respectively the second and third aspects of the invention.

The embodiment of the fourth aspect of the invention will now be described.

This embodiment is illustrated in FIG. 16 which shows a few of a row bristles which extends axially along a support stem 37 integrally fomed with, and projecting axially from the end of a carrier shaft, in a similar manner to that illustrated in FIG. 14. The shaft provides, or is attached at its other end to a handle for the applicator.

The bristles 39 are of substantially the same cross-sectional configuration as the bristles 36 in the known configuration, but in accordance with the fourth aspect of the invention, they are arranged so that their sectional length L′ in their base portions at which they integrally join the stem 37 extends circumferentially, and the sectional width W', which is smaller than the length L', extends axially of the stem.

As the applicator head passes through a wiping orifice, the bristles 39 will flex axially in one or other of the directions D, depending upon whether the applicator is being withdrawn, or reinserted into the cosmetics container. It will be appreciated that the teeth 39 in the arrangement of FIG. 16 flex more easily than the teeth 36 configured as shown in FIG. 15. In particular, the strain imposed upon the material of the base portions of the teeth is significantly reduced.

The features described above with reference to the embodiment of the fourth aspect may be combined to advantage in a single applicator with the features of any one, two, or all three of the previous three aspects of the invention. Thus, in any of the embodiments of the previous aspects having bristles, or other flexible filaments integrally molded with and projecting laterally fromm a support stem, some, or all of such filaments may be of generally elongate section at their base portions, their sectional width being substantially axial of the stem.

I claim:

1. An eyelash applicator for applying a liquid, semi-liquid creamy, pasty or viscous cosmetic material, comprising a handle by which the applicator can be manipulated, and a portion for retaining and applying said material, said retaining and applying portion comprising an elongate support and a multiplicity of closely spaced elongated flexible elements projecting laterally from said support for retaining and applying said material, said elements including at least first and second circumferentially adjacent rows extending along said support, the position of said elements of one row being longitudinally offset relative to the position of said elements in the other row, said elements of said first row forming interstices of a converging configuration with interstices formed by said elements of said second row to thereby grip eyelashes for applying said material thereto when the applicator is drawn through the eyelashes during use.

2. The applicator as claimed in claim 1, wherein said at least first and second rows are arranged in a spiral about said support.

3. The applicator as claimed in claim 1, wherein said elements are integrally molded with said support from plastic material.

4. The applicator of claim 1, wherein said elements have a conical shape.

5. An eyelash applicator for a liquid, semi-liquid, creamy, paste-like or viscous cosmetics material comprising a handle portion and a head portion having a stem and a multiplicity of flexible elements projecting laterally therefrom for retaining and applying said material, said multiplicity of elements being arranged along said stem to form between said elements interstices of a converging configuration with interstices of other said elements to thereby grip eyelashes for applying said material thereto when the applicator is drawn through the eyelashes during use.

6. The applicator as claimed in claim 5, wherein said elements are arranged in rows which extend parallel to the axis of said stem.

7. The applicator as claimed in claim 5, wherein said elements are arranged in a plurality of rows which are circumferentially distributed around the circumference of said stem.

8. The applicator as claimed in claim 7, wherein said elements are uniformly spaced along said rows, and said elements in adjacent rows are laterally offset by half the spacing between said elements so that said elements in every other row are in circumferential alignment.

9. The applicator as claimed in claim 8, wherein said plurality rows are arranged in a spiral about said stem.

10. The applicator as claimed in claim 5, wherein said elements are integrally molded with said stem from plastic material.

11. An eyelash applicator for a liquid, semi-liquid, creamy, paste-like or viscous cosmetics material comprising a handle portion and a head portion having a stem and a multiplicity of conical shaped elongated flexible elements projecting circumferentially therefrom for retaining and applying said material, said multiplicity elements being arranged along said stem to form between said elements interstices of a converging configuration with interstices of other said elements to thereby grip eyelashes for applying said material thereto when the applicator is drawn through the eyelashes during use.

12. The applicator as claimed in claim 11, wherein said elements are arranged in rows which extend parallel to the axis of said stem.

13. The applicator as claimed in claim 11, wherein said elements are arranged in a plurality of rows which are circumferentially distributed around the circumference of said stem.

14. The applicator as claimed in claim 13, wherein said elements are uniformaly spaced along said plurality of rows, and said elements in adjacent rows are laterally offset by half the spacing between said elements so that said elements in every other row are in circumferential alignment.

15. The applicator as claimed in claim 14, wherein said plurality of rows are arranged in a spiral about said stem.

16. The applicator as claimed in claim 11, wherein said elements are integrally molded with said stem from plastic material.

* * * * *

UNITED STATES PATENT AND TRADEMARK OFFICE

CERTIFICATE OF CORRECTION

PATENT NO. : 4,964,429

DATED : October 23, 1990

INVENTOR(S) : Rodney D. Cole

It is certified that error appears in the above-identified patent and that said Letters Patent is hereby corrected as shown below:

Column 2, line 34, "heat" should read --head--.
Column 4, line 14, "mde" should read --made--.
Column 4, line 20, "serve" should read --severe--.
Column 4, line 21, "breakkage" should read --breakage--.
Column 4, line 42, "impose" should read --imposes--.
Column 4, line 64, "whic" should read --which--.
Column 5, line 66, "separating" should read --separate--.
Column 6, line 19, "be" (second occurrence) should read --the--.
Column 7, line 4, "X13 X" should read --X-X--.
Column 7, line 47, "comprise" should read --comprises--.
Column 8, line 21, "adjacen" should read --adjacent--.
Column 8, line 44, "provide" should read --provided--.
Column 8, line 59, "fomed" should read --formed--.
Column 9, line 19, "fromm" should read --from--.
Column 10, line 30, after "tiplicity" insert --of--.
Column 10, line 44, "uniformaly" should read --uniformly--.

Signed and Sealed this

Third Day of March, 1992

*Attest:*

*Attesting Officer*

HARRY F. MANBECK, JR.

*Commissioner of Patents and Trademarks*